US009249376B2

(12) United States Patent
Tassey

(10) Patent No.: US 9,249,376 B2
(45) Date of Patent: Feb. 2, 2016

(54) CLEANING SOLUTION

(71) Applicant: Paul Tassey, Whitman, MA (US)

(72) Inventor: Paul Tassey, Whitman, MA (US)

( * ) Notice: Subject to any disclaimer, the term of this patent is extended or adjusted under 35 U.S.C. 154(b) by 0 days.

(21) Appl. No.: 14/589,977

(22) Filed: Jan. 5, 2015

(65) Prior Publication Data

US 2015/0191678 A1 Jul. 9, 2015

Related U.S. Application Data

(60) Provisional application No. 61/923,278, filed on Jan. 3, 2014.

(51) Int. Cl.

| | |
|---|---|
| ***C11D 1/72*** | (2006.01) |
| ***C11D 3/06*** | (2006.01) |
| ***C11D 3/20*** | (2006.01) |
| ***C11D 3/43*** | (2006.01) |

(52) U.S. Cl.

CPC *C11D 3/201* (2013.01); *C11D 1/72* (2013.01); *C11D 3/06* (2013.01); *C11D 3/2017* (2013.01); *C11D 3/2086* (2013.01); *C11D 3/43* (2013.01)

(58) Field of Classification Search

CPC ..... C11D 1/72; C11D 3/06; C11D 3/201; C11D 3/2017; C11D 3/2086

See application file for complete search history.

(56) References Cited

U.S. PATENT DOCUMENTS

| | | | | |
|---|---|---|---|---|
| 6,090,765 | A | 7/2000 | Black et al. | |
| 6,140,284 | A | 10/2000 | Cheung et al. | |
| 6,150,318 | A * | 11/2000 | Silvester et al. | 510/284 |
| 6,812,196 | B2 | 11/2004 | Rees et al. | |
| 8,287,658 | B2 | 10/2012 | Miralles et al. | |
| 8,632,636 | B1 * | 1/2014 | Tricca et al. | 134/6 |
| 2013/0225469 | A1 | 8/2013 | Allen et al. | |

* cited by examiner

*Primary Examiner* — Brian P Mruk

(74) *Attorney, Agent, or Firm* — Daniel Boudwin; Global Intellectual Property Agency LLC

(57) ABSTRACT

A cleaning solution is provided. The cleaning solution contains denatured alcohol, deionized water, and an organic surfactant mixture consisting of water, 2-butoxyethanol, sodium citrate, ethoxylated alcohol, and tetrapotassium pyrophosphate. The present invention is intended for use with granite, marble, or other shiny surfaces. The solution utilizes a minimal amount of surfactants and highly distilled alcohols that can safely clean and sterilize these surfaces, without leaving unpleasant residues behind.

9 Claims, No Drawings

CLEANING SOLUTION

CROSS REFERENCE TO RELATED APPLICATION

This application claims the benefit of U.S. Provisional Application No. 61/923,278 filed on Jan. 3, 2014. The above identified patent application is herein incorporated by reference in its entirety to provide continuity of disclosure.

FIELD OF THE INVENTION

The present invention relates to cleaning solutions. More specifically, the present invention relates to cleaning solutions comprising deionized water, denatured alcohol, and an organic surfactant mixture.

BACKGROUND OF THE INVENTION

Conventional cleaning products contain abrasive chemicals that can be difficult to wipe from granite and marble surfaces after use. This creates three main issues. First, if these abrasive chemicals linger on the granite or marble surface, they can cause damage to the surface. Second, if the surface is used for food preparation then the chemicals remaining on the surface can be transferred to the food products. Lastly, these products typically leave a cloudy, streaky, or oily residue that is unattractive and unpleasant. This unpleasant residue can also be a result of hard water within the cleaning solution, which can leave both visible and non-visible residues. Therefore, there is a need in the prior art for a cleaning solution that utilizes deionized water and biodegradable organic surfactants.

SUMMARY OF THE INVENTION

In view of the foregoing disadvantages inherent in the known types of cleaning solutions now present in the prior art, the present invention provides a cleaning solution comprising deionized water and organic surfactants wherein the same can be utilized for providing convenience for the user when cleaning granite or marble surfaces. The present system comprises denatured alcohol that is mixed with deionized water and an organic surfactant mixture. The present solution utilizes a minimal quantity of surfactants and highly distilled alcohols to kill pathogens, without leaving residues or causing damage to surfaces.

DETAILED DESCRIPTION OF THE INVENTION

For the purposes of presenting a brief and clear description of the present invention, the preferred embodiment will be discussed as used for cleaning granite or marble surfaces. However, this should not be read as limiting in any way and is intended solely to assist in the understanding of the present invention.

The present invention is a cleaning solution comprising denatured alcohol, deionized water, and one or more organic surfactants. The present invention is intended for use with granite, marble, or other shiny surfaces. The solution utilizes a minimal amount of surfactants and highly distilled alcohols that can safely clean and sterilize these surfaces, without leaving unpleasant residues behind. The cleaning solution can be applied directly to surfaces via a spray bottle or another such mechanism.

For one embodiment of the present invention, the deionized water, denatured alcohol, and surfactant mixture are provided in a ratio based upon volume of approximately 6400 to 21 to 1, respectively. The surfactant comprises water, 2-butoxyethanol, sodium citrate, ethoxylated alcohol, and tetrapotassium pyrophosphate provided in a ratio based upon volume of approximately 15 to 1.2 to 1.2 to 1 to 1, respectively. In one embodiment of the present invention, a slightly less than one-gallon volume of the solution contains 3610 ml of deionized water, 170 ml of denatured 100% ethyl alcohol, and 1 ml of surfactant. The surfactant comprises approximately 0.345 to 0.78 ml of water, 0.06 ml of 2-butoxyethanol, 0.06 ml of sodium citrate, 0.05 ml of an ethoxylated alcohol, and 0.05 ml of tetrapotassium pyrophosphate. An alternative embodiment of the present invention utilizes denatured 46% isopropyl alcohol in place of the 100% ethyl alcohol.

The deionized water is preferably laboratory-grade water that has had its mineral content removed, dissolved ion content removed, has been treated with UV light so that it is sterilized, and has been filtered through one or more filters to remove any particulates therein. Furthermore, at least one of the filters is preferably a 0.05-micron filter to ensure that the deionized water is substantially free from particulates. The present cleaning solution utilizes highly filtered, deionized water to help ensure that no residue is left behind on surfaces when the present cleaning solution is in use. Many prior art cleaning solutions utilize water softeners to mimic these effects; however, the addition of the water softeners increases the number of chemicals in the cleaning solutions and negatively impacts the environment. Because the present invention uses deionized, non-hard water, it does not require the use of water softener chemicals and therefore utilizes an overall fewer number of chemicals.

The denatured alcohol kills germs and other pathogens on the surface to which it is applied. Denatured, i.e. methylated, alcohol is utilized in order to prevent individuals from drinking the solution, ensuring that the present invention is in compliance with government regulations regarding the sale of alcoholic substances. The surfactant, or detergent, component of the present cleaning solution binds to grease, oil, or other hydrophobic compounds in order to remove those compounds from the surface being cleaned by the user. The surfactant is adapted to be biodegradable and environmentally-friendly, while still offering the ability to clean granite, marble, and other such surfaces.

The present solution is created by heating the denatured alcohol to 80 degrees Celsius. Once brought to that temperature, the surfactant and the deionized water are then added to the denatured alcohol and the solution is physically mixed into integrated. Once mixed, the resulting solution can then be administered using a spray bottle or other such conventional means.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of making a cleaning solution, consisting of:

heating a denatured alcohol to a temperature;

mixing the denatured alcohol with an organic surfactant mixture and water;

wherein the organic surfactant mixture is water, sodium citrate, and ethoxylated alcohol, and tetrapotassium pyrophosphate.

2. The method of making a cleaning solution of claim 1, wherein the denatured alcohol is denatured 100% ethyl alcohol.

3. The method of making a cleaning solution of claim 1, wherein the denatured alcohol is denatured 46% isopropyl alcohol.

4. The method of making a cleaning solution of claim 1, wherein the temperature is 80-degrees Celsius.

5. The method of making a cleaning solution of claim 1, consisting of:

3610 ml of the deionized water;

170 ml of the denatured 100% ethyl alcohol;

0.565 ml of the organic surfactant.

6. A cleaning solution, consisting of:

deionized water;

a denatured alcohol;

an organic surfactant mixture is water, sodium citrate, an ethoxylated alcohol, and tetrapotassium pyrophosphate.

7. The cleaning solution of claim 6, wherein the denatured alcohol is denatured 100% ethyl alcohol.

8. The cleaning solution of claim 6, wherein the denatured alcohol is denatured 46% isopropyl alcohol.

9. The cleaning solution of claim 6, wherein the deionized water is UV-sterilized and filtered through a 0.05 micron filter.

* * * * *